US008041251B2

(12) United States Patent
Nishi et al.

(10) Patent No.: US 8,041,251 B2
(45) Date of Patent: Oct. 18, 2011

(54) DEVELOPING DEVICE AND IMAGE FORMING DEVICE

(75) Inventors: Masayuki Nishi, Toyokawa (JP); Munenori Nakano, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 413 days.

(21) Appl. No.: 12/410,687

(22) Filed: Mar. 25, 2009

(65) Prior Publication Data

US 2010/0092205 A1 Apr. 15, 2010

(30) Foreign Application Priority Data

Oct. 9, 2008 (JP) ..... 2008-262444

(51) Int. Cl.
*G03G 15/08* (2006.01)

(52) U.S. Cl. ..... 399/103; 399/279; 399/286

(58) Field of Classification Search ..... 399/102, 399/103, 252, 265, 279–286
See application file for complete search history.

(56) References Cited

FOREIGN PATENT DOCUMENTS

| | | | |
|---|---|---|---|
| JP | 6-258933 A | | 9/1994 |
| JP | 2000-194191 | * | 7/2000 |
| JP | 2005-106988 A | | 4/2005 |

* cited by examiner

*Primary Examiner* — Hoan Tran
(74) *Attorney, Agent, or Firm* — Buchanan Ingersoll & Rooney PC

(57) ABSTRACT

A developing device used for forming a toner image by developing the electrostatic latent image on an electrostatic latent image carrier in an image forming device, comprises a developer carrier roller which is rotationally driven, and a toner thin layer forming member which is brought into contact with the developer carrier roller, wherein the developer carrier roller is formed in the shape of an inverted crown which is concave at the central portion in the direction of the rotation axis, and a starting point of the shape of the inverted crown is positioned further outside in the direction of the rotation axis than toner thin layer region formed by the toner thin layer forming member.

16 Claims, 10 Drawing Sheets

DEVELOPING DEVICE AND IMAGE FORMING DEVICE

CROSS-REFERENCE TO RELATED APPLICATION

This invention is based on Japanese Patent Application No. 2008-262444 filled with Japan Patent Office on Oct. 9, 2008, the entire content of which is hereby incorporated by reference.

BACKGROUND OF THE INVENTION

1. Field of the Invention

The present invention relates to a developing device used for an image forming device which forms a toner image, such as a copying machine, a printer, a facsimile machine or a multifunctional machine which is a combination of two or more of these devices, especially to a technique for preventing spillage and scattering of a toner in a mono-component developing device. Moreover, the present invention also relates to an image forming device comprising a developing device.

2. Description of the Related Art

In an image forming device which forms a toner image such as a copying machine, a printer, a facsimile machine or a multifunctional machine which is a combination of two or more of these devices, normally, an electrostatic latent image is formed on an electrostatic latent image carrier such as a photoreceptor in an exposure process; this electrostatic latent image is developed to form a visible toner image in a development process; this visible toner image is transferred onto a recording medium such as recording paper in a transferring process, or is primarily transferred onto an intermediate transfer member such as an intermediate transfer belt temporarily and is secondary transferred onto the recording medium from this intermediate transfer member; and the toner image transferred onto the recording medium in such a manner is fixed on the recording medium in a fixing process.

In the development process, for example, so-called non-contact development is sometimes carried out, in which a drum photoreceptor which is an electrostatic latent image carrier and a developing roller which is a developer carrier are supported and spaced at a constant interval to form an electric field between the developing roller and the drum photoreceptor, and a toner which is a developer on the developing roller is caused to fly over the electrostatic latent image on the drum photoreceptor to visualize the latent image. In such a non-contact development, it has been important to accurately maintain the interval between the drum photoreceptor and the developing roller.

Accordingly, the methods which are currently employed include the followings: a method in which spacers such as rollers each having a radius larger than that of the developing roller by a predetermined clearance are supported at both ends of the developing roller, and thrusted against the outer periphery of the drum photoreceptor; and a method in which a contact member is provided on a box which supports the drum photoreceptor and is brought into contact with the outer peripheral surface of the developing roller.

In such an image forming device, in order to supply a toner which is the developer onto the developing roller and uniformly apply the toner onto the developing roller to form a thin layer thereon, a toner supply roller and a thin layer forming blade are brought into contact with the developing roller. Accordingly, the developing roller is pushed in the direction of the drum photoreceptor by the contacting pressures of the toner supply roller and thin layer forming blade, whereby warping occurs in the developing roller, which prevents maintaining the predetermined clearance. As a result, a difference in developed density is disadvantageously created between the central portion and both ends of the developing roller.

Measures for solving this problem include rendering the developing roller in the shape of an inverted crown (the shape which is concave at the central portion in the direction of the rotation shaft). For example, Japanese Unexamined Patent Publication No. H6-258933 discloses an image forming device comprising at least a developing unit and an image carrier, the developing unit comprising at least a developer carrier, a developing container which rotatably supports the developer carrier, a contact member which is in contact with the above developer carrier, and when deformation is produced in the above developer carrier by the contacting pressure of the above contact member, the central portion of the circumferential surface of the image carrier or the developer carrier is formed in a convex or concave shape so that the distance between the circumferential surface of the image carrier and the circumferential surface of the opposing developer carrier has a predetermined value throughout their entire areas.

According to the image forming device disclosed in this publication, the central portion of the developer carrier or image carrier has a convex or concave shape, and therefore when deformation is produced in the developer carrier by a contacting pressure P of the contact member which comes into contact with the developer carrier, the distance between the circumferential surface of the image carrier and that of the developer carrier can have a predetermined value throughout their entire areas.

In a developing roller having the shape of an inverted crown, When the starting point (initial point) of this shape of an inverted crown is present in a region in which an image is formed (in the region where a toner thin layer is present), a change in curvature at the starting point is large, and therefore the contacting state of the roller and the thin layer forming blade becomes unstable even if the thin layer forming blade is formed from an elastic material, which forms a gap therebetween. This problem not only occurs when an elastic rubber roller (a roller around the periphery of which an elastic rubber layer is provided as the core) is used as the developing roller, but, for example, becomes especially noticeable when a hollow aluminium blast roller (coreless hollow metal roller mainly composed of aluminium having unevenness formed on its outer peripheral surface by the shot blast method to improve its ability to carry toner) is employed. Such a gap may lead to spillage of the toner from the thin layer forming blade; scattering of the toner from a diselectrifying member which is sometimes in contact with the developing roller; and insufficient leakage prevention of the toner by the toner sealing member disposed for both ends of the developing roller.

However, in the above-mentioned Japanese Unexamined Patent Publication No. H6-258933, no consideration is paid to the fact that the contacting state of the thin layer forming blade and the developing roller becomes unstable because of such a shape of an inverted crown. Accordingly, in the image forming device disclosed in this publication, the toner may spill into the image forming device, scatter and leak, and thus may contaminate the inside of the image forming device.

SUMMARY OF THE INVENTION

To this end, a first object of the present invention is to provide an image forming device which is capable of forming an electrostatic latent image on an electrostatic latent image carrier and develop the electrostatic latent image to form a toner image, the image forming device being a mono-component developing device used for development of the electrostatic latent image, comprising a developer carrier roller which is rotationally driven and a toner thin layer forming member which is brought into contact with this roller, the roller being formed in the shape of an inverted crown which is concave at the central portion in the direction of the rotation shaft (the direction of the rotation axis of the developer carrier roller), the image forming device being capable of maintaining the clearance between the developer carrier roller and a drum photoreceptor to a constant value and carrying out good image formation, and inhibiting spillage, scattering and leakage of the toner to prevent the inside of the image forming device from being contaminated even if the developer carrier roller has the shape of an inverted crown.

A second object of the present invention is to provide an image forming device which is capable of forming an electrostatic latent image on an electrostatic latent image carrier and develop the electrostatic latent image by a developing device to form a toner image, maintaining the clearance between the developer carrier roller and the drum photoreceptor to a constant value and carrying out good image formation, and inhibiting contamination of the inside of the image forming device by spillage, scattering and leakage of the toner even if the developer carrier roller has the shape of an inverted crown.

In order to achieve the first object, the present invention provides the following developing device:

A developing device used for forming a toner image by developing the electrostatic latent image on an electrostatic latent image carrier in an image forming device, comprising: a developer carrier roller which is rotationally driven, and a toner thin layer forming member which is brought into contact with the developer carrier roller, wherein the developer carrier roller is formed in the shape of an inverted crown which is concave at the central portion in the direction of the rotation axis, and a starting point of the shape of the inverted crown is positioned further outside in the direction of the rotation axis than toner thin layer region formed by the toner thin layer forming member.

In this developing device, the developer carrier roller has the shape of an inverted crown, and a change in curvature is large in the starting point (initial point) of this shape of an inverted crown. Therefore, the contacting state of the toner thin layer forming member and the developer carrier roller is unstable and a gap is formed therebetween. However, the starting point of this shape of an inverted crown exists outside the toner thin layer region. That is, the starting point of the shape of an inverted crown is positioned further outside (end side) in the direction of the rotation shaft than the toner thin layer region. In the toner thin layer region, the contacting state of the toner thin layer forming member and the developer carrier roller is stable (the contacting and nipping state is stable), and therefore spillage of the toner from the toner thin layer forming member can be inhibited.

In order to achieve the second object, the present invention also provides the following image forming device:

an image forming device which is capable of forming an electrostatic latent image on an electrostatic latent image carrier and develop the electrostatic latent image by a developing device to form a toner image, wherein at least one developing device is the above-mentioned developing device.

The image forming device according to the present invention comprises the developing device according to the present invention as a developing device, and this developing device can maintain the clearance between the developer carrier roller and the electrostatic latent image carrier constant and allow good image formation, and at the same time inhibit spillage, scattering and leakage of the toner even if the developer carrier roller has the shape of an inverted crown, and thus can prevent contamination of the inside of the image forming device.

The foregoing and other objects, features, aspects and advantages of the present invention will become more apparent from the following detailed description when taken in conjunction with the accompanying drawings.

DESCRIPTION OF THE PREFERRED EMBODIMENTS

An image forming device comprising a developing device according to an embodiment of the present invention will be described in detail below with reference to accompanying drawings. The developing device according to an embodiment of the present invention can be employed in a plurality of types of image forming devices by making some modification depending on the type of image forming device. Accordingly, a typical image forming device will be described first. In the description below, identical parts are denoted by identical numerals. Their names and functions are also identical. Therefore, the detailed description of them is not repeated.

[Overall Constitution of Image Forming Device (Four-Cycle Type)]

Figure 1:
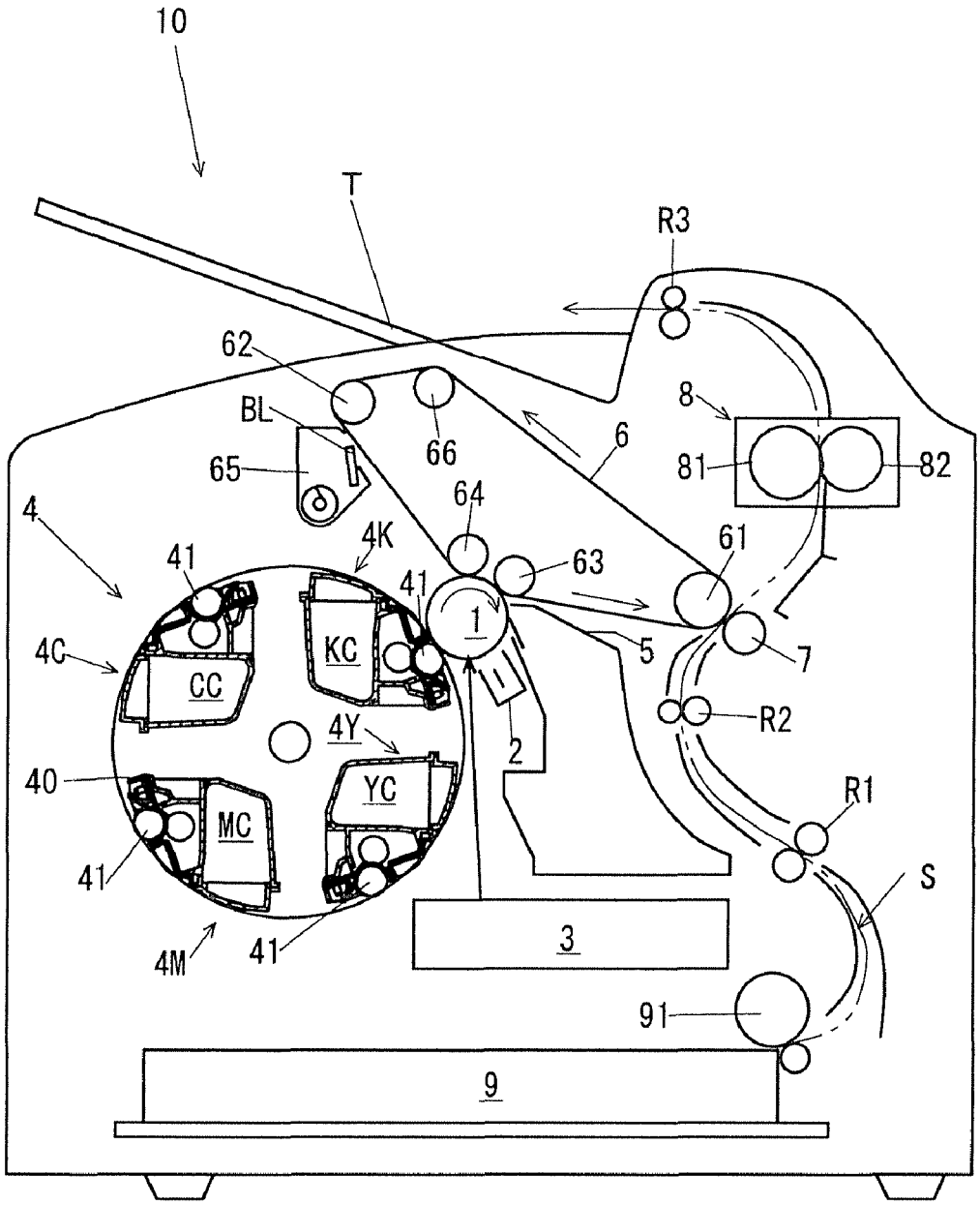
FIG. 1 is a drawing which shows the outline of the constitution of an image forming device according to an embodiment of the present invention.

FIG. 1 shows a developing device 10 comprising an image forming device according to this embodiment. The image forming device 10 of FIG. 1 is a so-called four-cycle type full-color image forming device. In the description below, the recording medium is recording paper and the toner is a mono-component toner which has no carrier.

The image forming device 10 comprises a drum photoreceptor 1 (hereinafter referred to as photoreceptor 1), and an electrifier 2, a developing unit 4, an intermediate transfer belt 6 and a cleaning device 5 are disposed therearound in the order stated. an image exposure device 3 which carries out image exposure is provided from between the electrifier 2 and the developing unit 4 to the photoreceptor 1, and a recording paper feed section 9 is provided therebelow.

The photoreceptor 1 is rotationally driven in the clockwise direction in the figure by a photoreceptor drive motor (not illustrated). A voltage for electrifying photoreceptor is applied to the electrifier 2 from an output-variable power supply for electrification (not illustrated) at a predetermined timing.

The developing unit 4 is composed by a black developing device 4K, a cyan developing device 4C, a magenta developing device 4M and a yellow developing device 4Y mounted on a developing device rack 40. The developing device rack 40 can be rotationally driven in the counterclockwise direction in the figure around a drive unit, which is not illustrated, comprising a stepping motor. The developing devices are amounted on the developing device rack 40 at equal center angle intervals of 90 degrees in the order of the rack of the developing devices 4K, 4C, 4M, 4Y in the direction of the rotation.

A black toner cartridge KC is mounted on the black developing device 4K; a cyan toner cartridge CC is mounted on the cyan developing device 4C; a magenta toner cartridge MC is mounted on the magenta developing device 4M; and a yellow toner cartridge YC is mounted on the yellow developing device 4Y, each being mounted replaceably. A developing roller (developer carrier roller, toner carrier roller) 41 for developing the electrostatic latent image on the photoreceptor 1 is mounted on each developing device.

Each developing device comprises, as described in detail later, in addition to the developing roller 41, a toner supply roller for supplying the toner to the developing roller 41, a toner controlling blade which controls the thickness of a layer of the toner supplied from the toner supply roller on the developing roller 41, among others. Each developing device can reversal-develop the electrostatic latent image on the photoreceptor 1 by using a negatively charged toner.

Each developing device can position the electrostatic latent image on the photoreceptor 1 in a development position where the image is developed by the developing roller 41 by rotating the developing device rack 40. The developing roller 41 disposed in the development position faces the surface of the photoreceptor 1, which allows application of a development bias from an output-variable development bias power supply (not illustrated). This also allows the developing roller 41 disposed in the development position to be rotationally driven by a developing roller drive motor (not illustrated) in the counterclockwise direction in the figure. Further, application of a toner supply bias from a power supply, which is not illustrated, to the toner supply roller is enabled, whereby a controlling bias can be applied to the toner controlling blade.

The intermediate transfer belt 6 is wound on a group of rollers comprising a drive roller 61, a driven opposing roller 62 which opposed the drive roller 61, a primary transfer roller 63 disposed to oppose the photoreceptor 1, a roller 64 which brings the intermediate transfer belt 6 with the photoreceptor 1 in cooperation with the primary transfer roller 63 and a tension roller 66.

A primary transfer voltage can be applied from the power supply for primary transferring, which is not illustrated, to the primary transfer roller 63. The drive roller 61 is rotationally driven in the counterclockwise direction in the figure by a transfer belt drive motor, which is not illustrated, whereby the intermediate transfer belt 6 can be rotated in the counterclockwise direction.

A secondary transfer roller 7 is disposed for a portion which is wound on the drive roller 61 of the intermediate transfer belt 6. The secondary transfer roller 7 is moved towards and away from the intermediate transfer belt 6 at predetermined timings. A secondary transfer voltage can be applied from a secondary transferring power supply, which is not illustrated, to the secondary transfer roller 7.

A cleaning device 65 which removes paper dust and the like (including remaining toner from secondary transferring) is disposed for a portion which is wound on the roller 62 opposing of the intermediate transfer belt 6. This cleaning device 65 is provided with cleaning blade BL which removes paper dust and the like of the intermediate transfer belt 6.

A fixing apparatus 8 is provided above the secondary transfer roller 7, and a recording paper discharging roller R3 and recording paper discharging tray T are provided on the downstream side of the roller in the order stated.

A pair of timing rollers R2 and a pair of guide rollers R1 which guide a recording paper S from a recording paper container 9 to the pair of the timing rollers R2 are disposed below the secondary transfer roller 7.

According to the image forming device 10 described above, in FIG. 1, a toner image can be formed on the recording paper S by using one or more a toner image can be formed on the recording paper S by using one or more of the developing devices 4K, 4C, 4M and 4Y under instruction by a controlling unit, which is not illustrated. An example in which a full-color image is formed by using four developing devices will be described below.

First, the developing device rack 40 is rotated by a rack drive unit, which is not illustrated to dispose the yellow developing device 4Y in a development position in which its developing roller 41 comes into contact with the photoreceptor 1, and the photoreceptor 1 is rotated in the clockwise direction in the figure to rotate the intermediate transfer belt 5. At this stage, the secondary transfer roller 7 is spaced away from the intermediate transfer belt 6.

The surface of the rotating photoreceptor 1 is uniformly electrified to have a predetermined potential by the electrifier 2 to which a voltage for electrification is applied from the power supply for electrification. The electrified region is subjected to image exposure for a yellow image by the image exposure device 3 to form a yellow electrostatic latent image, and this yellow electrostatic latent image is developed by the developing device 4Y to form a yellow toner image. This yellow toner image is primarily transferred onto the intermediate transfer belt 6 by the primary transfer roller 63 to which a primary transfer voltage is applied.

Further, the magenta developing device 4M is disposed in a development position to form a magenta toner image on the photoreceptor 1; this is transferred onto the intermediate transfer belt 6; then the cyan developing device 4C is disposed in a development position to form a cyan toner image on the photoreceptor 1; this is transferred onto the intermediate transfer belt 6; then the black developing device 4K is disposed in a development position to form a black toner image on the photoreceptor 1; and this image is transferred onto the intermediate transfer belt 6. Formation of the color toner images on the photoreceptor 1 and primary transference of the same onto the intermediate transfer belt 6 are carried out at a timing when these toner images are transferred onto the intermediate transfer belt 6 on top of each other.

When primary transference onto the intermediate transfer belt 6 is being carried out, the cleaning blade BL of the cleaning device 65 is spaced away from the intermediate transfer belt 6.

Meanwhile, when the recording paper S is withdrawn from the recording paper feed section 9 by the supply roller 91 and supplied towards the pair of timing rollers R2, and an end of the recording paper is detected by a timing sensor, which is not illustrate, on the outlet side of the pair of timing rollers R2, the pair of timing rollers R2 are stopped and the recording paper S is held there.

The secondary transfer roller 7 is brought into contact with the intermediate transfer belt 6 before the multiple-toner image on the intermediate transfer belt 6 reaches the secondary transfer roller 7 by the rotation of the intermediate transfer belt 6, and the recording paper S is also transferred to the secondary transfer region by the pair of timing rollers R2 at a timing when the multiple-toner image reaches the secondary transfer region.

Thus, the multiple-toner image is secondarily transferred onto the recording paper S. The toner image on the recording paper S on which the multiple-toner image has been transferred is fixed by the fixing apparatus 8, and is discharged into to the discharge tray T by the recording paper discharging roller R3. Thus, the recording paper S on which a full-color image is formed can be obtained.

The toner and other matters remaining from the primary transference are removed and cleaned by the cleaning device 5, and the paper dusts and other matters (including remaining toner from the secondary transference) on the intermediate transfer belt 6 are removed and cleaned by the cleaning device 65. At this time, the cleaning blade BL of the cleaning device 65 is thrusted against the intermediate transfer belt 6.

The developing device according to this embodiment can be also applied not only to such a four-cycle type image forming device but also to an image forming device as shown below.

[Overall Constitution of Image Forming Device (Tandem Type)]

Figure 2:
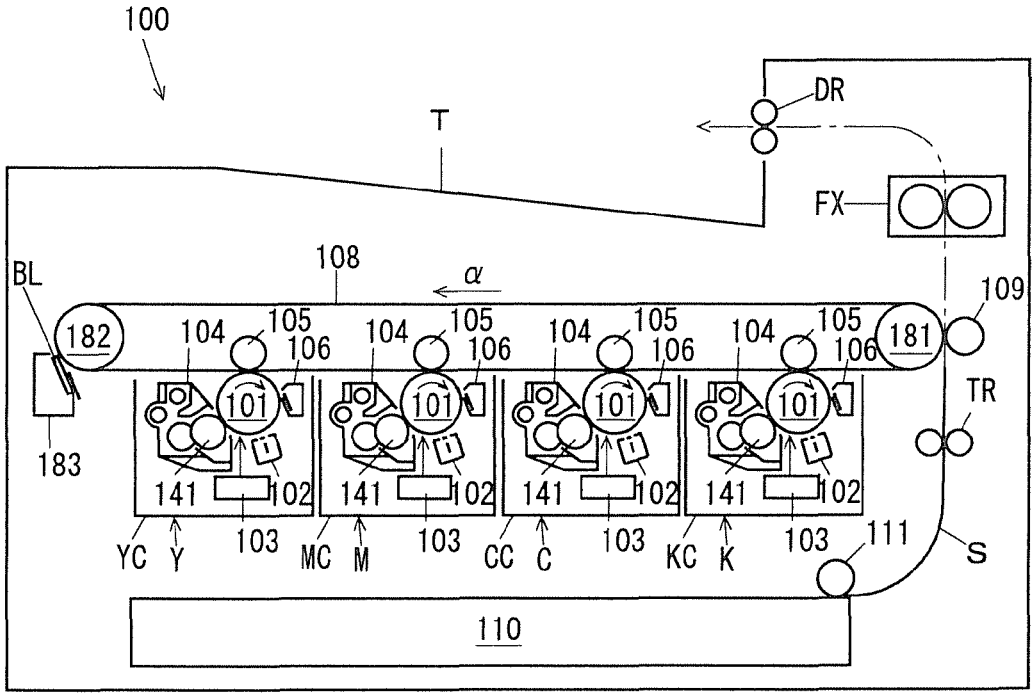
FIG. 2 is a drawing which shows the outline of another constitution of an image forming device according to an embodiment of the present invention.

FIG. 2 shows a developing device 100 comprising an image forming device according to this embodiment. The image forming device 100 of FIG. 2 is a so-called tandem type full-color image forming device.

The image forming device 100 has a drive roller 181, and an endless intermediate transfer belt 108 wound on a roller 182 opposing the roller 181. The intermediate transfer belt 108 is rotated in the counterclockwise direction (the direction of the arrow in the figure) $\alpha$ in the figure by the drive roller 181 driven by a belt driving unit.

The drive roller 181 opposes a secondary transfer roller 109 across the intermediate transfer belt 108, and the roller 182 opposing the drive roller 181 opposes a cleaning device 183 which cleans remaining toner and other matters. This cleaning device 183 is provided with a cleaning blade BL which removes paper dusts and other matters on the intermediate transfer belt 108.

The secondary transfer roller 109 has a surface layer portion which is formed from an elastic material; is pressed against a portion of the intermediate transfer belt 108 which is supported by the drive roller 181 by a pressing means, which is not illustrated; form a nipping portion between itself and the intermediate transfer belt 108; and can be rotated by the rotation of the intermediate transfer belt 108, or, by the transference of the recording paper S which is transferred into this nipping portion, as described later. A secondary transfer bias can be applied from a power supply, which is not illustrated, to the secondary transfer roller 109 at a predetermined timing.

A fixing apparatus FX is disposed above the intermediate transfer belt 108 and the secondary transfer roller 109. A pair of timing rollers TR are disposed below the belt 108 and the roller 109, and a recording paper container cassette 110 which contains recording paper S is disposed therebelow.

The fixing apparatus FX comprises a fixing and heating roller which has a heat source such as a halogen lamp heater integrated therein and a pressing roller which is thrusted against this fixing and heating roller. The recording paper S contained in the recording paper container cassette 110 can be withdrawn sheet by sheet by a recording paper supply roller 111 and supplied to the pair of timing rollers TR.

Between the drive roller 181 and roller 182 on which the intermediate transfer belt 108 is wound, a yellow image forming unit Y, a magenta image forming unit M, a cyan image forming unit C and a black image forming unit K are disposed in the order stated along the intermediate transfer belt 108 from the roller 182 towards the drive roller 181.

Each of the image forming units Y, M, C AND K comprises a drum-shaped photoreceptor 101 as an electrostatic latent image carrier, and an electrifier 102, an image exposure device 103, a developing device 104, a primary transfer roller 105 and a cleaning device 106 are disposed in the order stated around the photoreceptor 101.

In each of the image forming units, a process cartridge which comprises the photoreceptor 101, the electrifier 102, the developing device 104 and the cleaning device 106 is formed. The process cartridges are: a yellow process cartridge YC for forming the yellow image forming unit Y, a magenta process cartridge MC for forming the magenta image forming unit M, a cyan process cartridge CC for forming the cyan image forming unit C, and a black process cartridge KC for forming the black image forming unit K. Each of the process cartridges can be attached to and detached from the image forming device body.

The primary transfer roller 105 faces the photoreceptor 101 with the intermediate transfer belt 108 interposed therebetween, and is rotated by the travel of the intermediate transfer belt 108. A primary transfer bias for primarily transferring the toner image formed on the photoreceptor 101 to the primary transfer roller 105 can be applied from a power supply, which is not illustrated, to the intermediate transfer belt 108 at a predetermined timing. The image exposure device 103 can subject the photoreceptor 101 to image exposure by the dot exposure by flashing of a laser beam in response to image information.

The photoreceptor 101 in each of the image forming units herein is a negatively-charged photoreceptor, and can be rotationally driven in the clockwise direction in the figure by a photoreceptor drive motor, which is not illustrated. The electrifier 102 in each of the image forming units is, but not limited to, a scorotron electrifier in this example, and a voltage for electrification is applied thereto from a power supply at a predetermined timing.

The developing device 104 in each of the image forming units can reversal-develop an electrostatic latent image formed on the photoreceptor 1 as described in detail later, by a developing roller 141 to which a development bias is applied from a power supply, which is not illustrated.

According to the image forming device 100 described above, in FIG. 2, a toner image can be formed on the recording paper S by using one or more of the image forming units Y, M, C and K under instruction by a control unit, which is not illustrated. An example of the case where a full-color image is formed by using all of the image forming units Y, M, C and K will be described below.

First, a yellow toner image is formed in the yellow image forming unit Y, and this image is primarily transferred to the intermediate transfer belt 108. That is, in the yellow image forming unit Y, the photoreceptor 101 is rotationally driven in the clockwise direction in the figure; the surface is uniformly electrified to have a predetermined potential by the electrifier 102; the region (electrified region) electrified to have the predetermined potential is subjected to image exposure for yellow image from the exposure apparatus 3; and an electrostatic latent image for yellow is formed on the photoreceptor 101. This electrostatic latent image is developed by the developing roller 141 to which the development bias of the developing device 104 having a yellow toner is applied to become a visible yellow toner image, and this visible yellow toner image is primarily transferred onto the intermediate transfer belt 108 by the primary transfer roller 105. At this time, a primary transfer bias is applied to the primary transfer roller 105 from a power supply, which is not illustrated.

Likewise, a magenta toner image is formed in the magenta image forming unit M and transferred to the intermediate transfer belt 108, a cyan toner image is formed in the cyan image forming unit C and transferred to the intermediate transfer belt 108, and a black toner image is formed in the black image forming unit K and transferred to the intermediate transfer belt 108.

The toner images of yellow, magenta, cyan and black are formed at a timing when these are transferred onto the intermediate transfer belt 108 on top of another. The multiple-toner image formed in such a manner on the intermediate transfer belt 108 moves to the secondary transfer roller 109 by the rotation of the intermediate transfer belt 108.

Meanwhile, the recording paper S is withdrawn from the recording paper container cassette 110 by the recording paper supply roller 111, and is supplied to the pair of timing rollers TR and held there.

The recording paper S which is held at the pair of timing rollers TR in this manner is supplied into the nipping portion between the intermediate transfer belt 108 and the secondary transfer roller 109 in synchronization with the transference of the multiple-toner image which is transferred to the intermediate transfer belt 108, and this multiple-toner image is secondarily transferred onto the recording paper S by the secondary transfer roller 109 to which the secondary transfer bias is applied from the power supply, which is not illustrated. The recording paper S is then passed through the fixing apparatus FX, where the multiple-toner image is fixed onto the recording paper S with heating under pressure. The recording paper S is successively discharged into a discharge tray T by a pair of discharge rollers DR. The recording paper S on which a full-color image is formed can be thus obtained.

The toner and other matters remaining from the transference on the photoreceptor 101 in the primary transference of the toner image onto the intermediate transfer belt 108 are cleaned by the cleaning device 106. The toner and other matters remaining from the secondary transference on the intermediate transfer belt 108 are cleaned by the device 183.

[Developing Device]

A developing device according to this embodiment which can be applied to both the four-cycle type image forming device 10 and the tandem type image forming device 100 as it is or with some modification will be described. It should be noted that the developing device according to this embodiment can be employed in any of the black developing device 4K, cyan developing device 4C, magenta developing device 4M and yellow developing device 4Y in the developing unit 4 of the image forming device 10, and the black process cartridge KC, cyan process cartridge CC, magenta process cartridge MC and yellow process cartridge YC of the developing device 104 of the image forming device 100. Furthermore, the developing device according to this embodiment can be also applied to monochrome image forming devices, in addition to the above-mentioned four-cycle type and tandem type full-color image forming devices with some appropriate modification. The case where the developing device according to this embodiment is employed as the black developing device 4K of the developing unit 4 of the image forming device 10 will be described below.

Figure 3A:
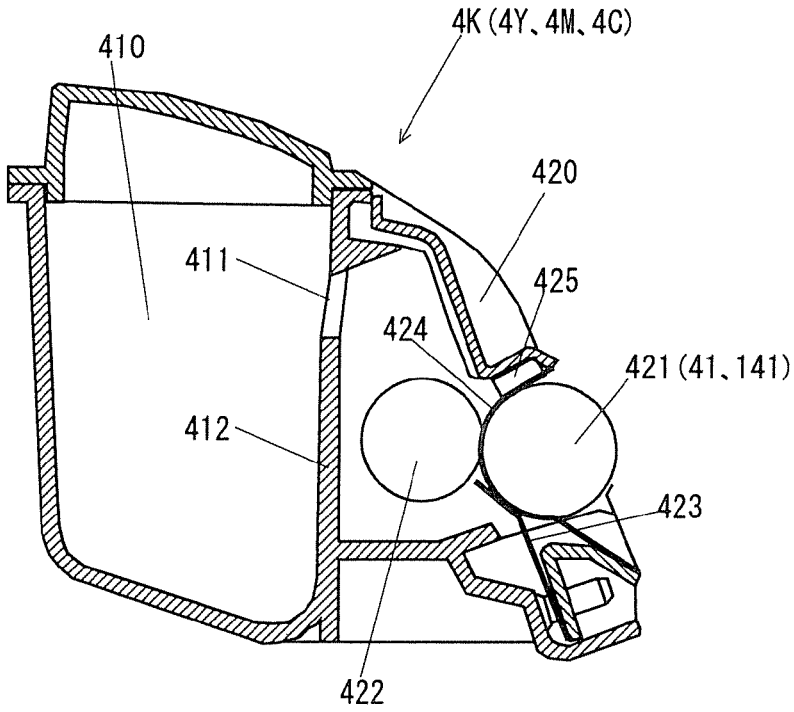
FIGS. 3A and 3B are the drawings which show a developing device employed in the image forming device according to an embodiment of the present invention.
Figure 3B:
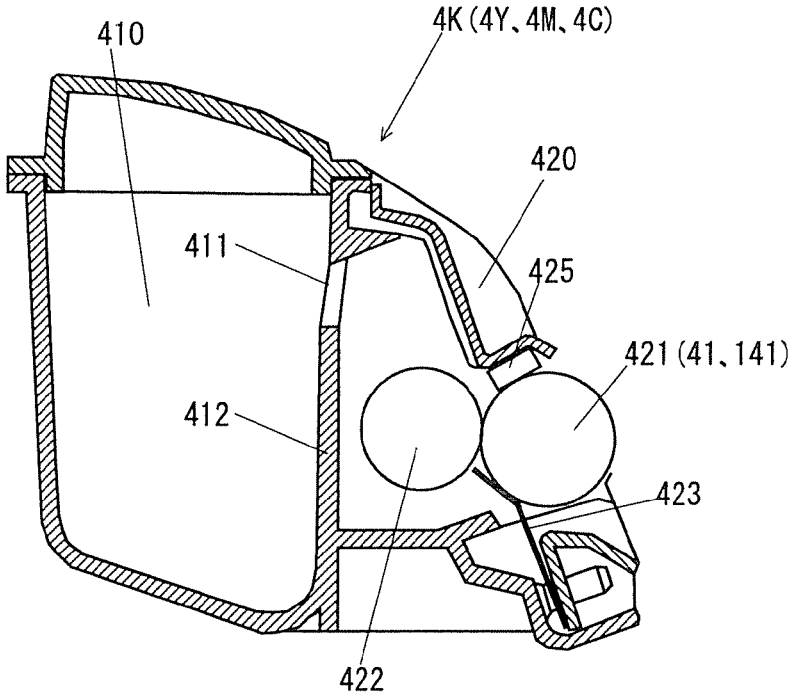

FIG. 3A shows a cross-sectional view of the vicinity of an end portion (the end portion which is in the direction opposite to the central portion of the developing device 4K in the direction along the rotation shaft) of the black developing device (hereinafter sometimes simply referred to as "developing device") 4K, and FIG. 3B shows a cross-sectional view of the vicinity of the central portion (the central portion of the developing device 4K in the direction along the rotation shaft) of the developing device 4K. The developing device 4K, as shown in FIGS. 3A and 3B, comprises a toner storage portion 410, a head portion 420 having a developing roller 421 and other components, a partition wall 412 between the toner storage portion 410 and the head portion 420, and a communication opening portion 411 which is upwardly continuous from the partition wall 412. The developing roller 421 may be the developing roller 41 in FIG. 1, or may be the developing roller 141 in FIG. 2. The developing roller 421 may be an elastic rubber roller comprising a core or a hollow aluminium blast roller. Moreover, the outer diameter of this developing roller 421 is about 10 mm to 20 mm.

The head portion 420 has, in addition to the developing roller 421, a toner supply roller 422 for supplying the toner to the developing roller 421, and a blade type toner controlling member (toner thin layer forming member) 423 which controls the thickness of a layer of the toner supported by the developing roller 421 and is transferred to the region where the electrostatic latent image is developed and electrifies the toner by friction, and a diselectrifying member 425 which diselectrifies the toner which has not been used in the development region and has been returned into the case of the developing device 4K in a state that it is left supported by the developing roller 421. The toner controlling member 423 is formed from, for example, a sheet-like body made of stainless steel. The toner controlling member (toner thin layer forming member) 423 may be any member as long as it can control the thin layer of the toner transferred to the development region opposing the photoreceptor 1 by the developing roller 421 and electrify the toner by friction, but typical examples include a sheet-like component provided along the rotation shaft of the developing roller 421, as mentioned above.

The developing devices can be sequentially disposed in development positions by the rotation of the developing device rack 40 in the counterclockwise direction (hereinafter sometimes referred to as "forward direction"). FIGS. 1 and 3 show the state that the black developing device 4K is disposed in a development position. As shown in these figures, the developing roller 421 of the developing device faces the photoreceptor 1 when it is in the development position so that it can develop the electrostatic latent image on the photoreceptor 1. The developing device disposed in the development position has a posture which is slightly inclined from a horizontal plane containing the center axis of the rotation shaft of the developing device rack 40 towards the direction of the reverse rotation of the developing device rack 40.

When each of the developing devices makes a full rotation about the rotation shaft of the rack by a full rotation in the forward direction of the developing device rack 40 from a state that it is disposed in the development position, the toner in the toner storage portion 410 moves to the side of the communication opening portion 411 by its own weight. The toner which has moved to the opening portion 411 side can further move beyond the partition wall 412, and can flow into the head portion 420 through the communication opening portion 411 by its own weight. In the head portion 420, the toner is accumulated around the toner supply roller 422 and in other portions.

A development bias is applied to the developing roller 421 of the developing device 4K which is disposed in the development position and used for developing the electrostatic latent image on the photoreceptor 1; a supply bias is applied to the toner supply roller 422; a controlling bias is applied to the toner controlling member 423; and a diselectrifying bias is applied to the diselectrifying member 425, each from a power supply, which is not illustrated. The diselectrifying member 425 in this example is composed of a sponge material and a conductive film placed thereon. This conductive film faces the developing roller 421.

The developing roller 421 of the developing device 4K which is disposed in the development position and used for developing the electrostatic latent image on the photoreceptor 1 and the toner supply roller 422 are rotationally driven by the developing roller drive motor. At this time, the developing roller 421 and the toner supply roller 422 are rotated in the counterclockwise direction in the figure. At least a surface layer portion of the toner supply roller 422 is made from a foam material, and the toner accumulated in the head portion 420 is supplied to the developing roller 421 by the physical force caused by the difference in peripheral speed between these rollers and by the supply bias supplied from the power supply, which is not illustrated. The toner supply roller 422 also functions to scrape off the toner which is supported by the developing roller 421 and is returned into the developing device case from the developing roller 421.

A toner sealing member 424 is provided at both ends of the developing roller 421. As described later, in the toner sealing member 424, a member composed of a base material and piles implanted therein and having a thickness of about 0.5 mm to 1.0 mm is supported by the developing device case with an elastic foam interposed therebetween. This toner sealing member 424 and the toner controlling member 423 are overlapping at both ends of the developing roller 421.

The developing device shown in FIG. 3 cannot be applied to the tandem type image forming device 100 shown in FIG. 2 as it is. This is because the developing devices in the tandem type image forming device 100 shown in FIG. 2 do not rotate unlike in the four-cycle type image forming device 10 shown in FIG. 1. Accordingly, it is necessary to change its structure so that each developing device is provided with a toner stirring supply roller or other means for supplying the toner to the toner supply roller or into the space where the developing roller is present, or that the toner is supplied from the toner cartridge into such a space.

Figure 4:
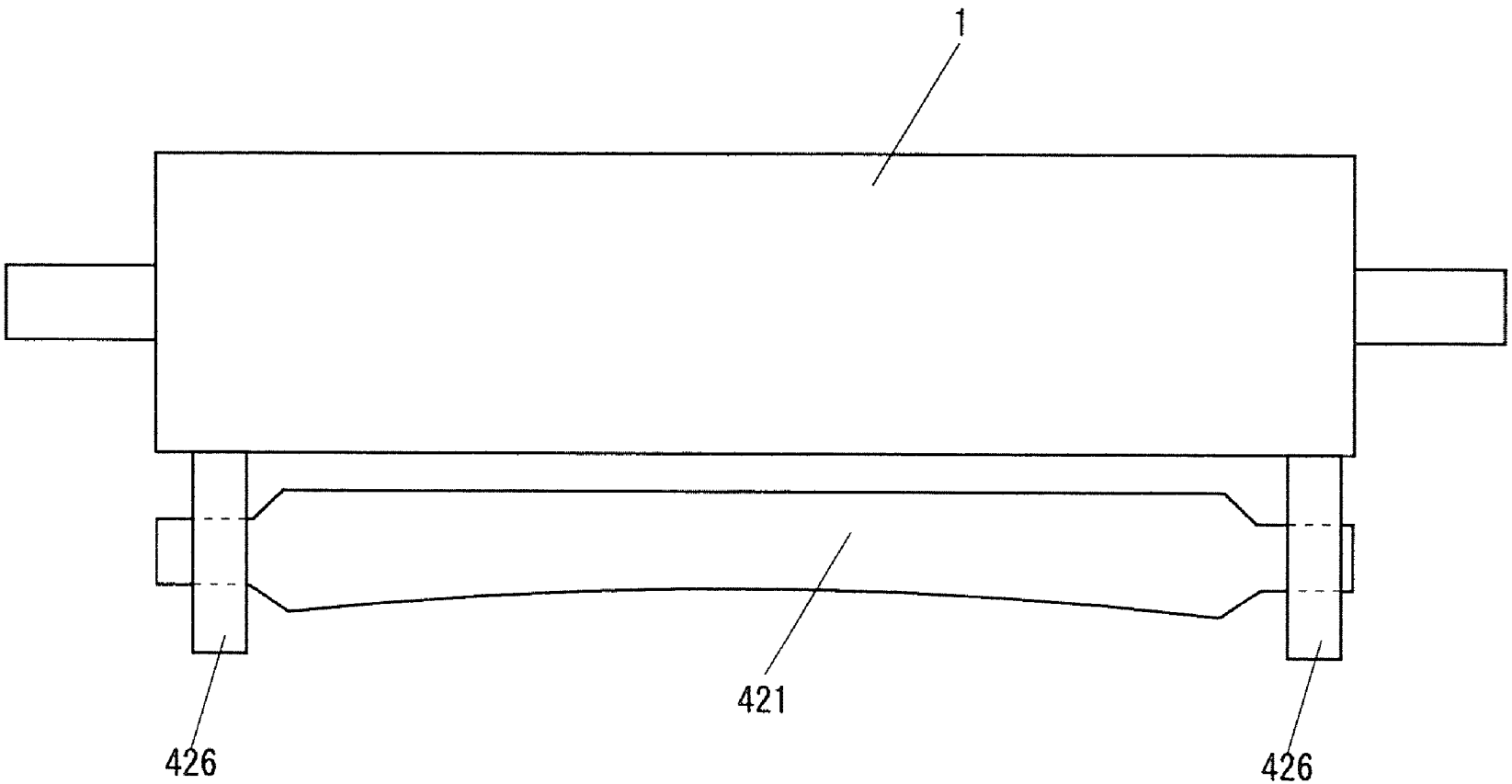
FIG. 4 is a drawing which shows of the relationship between the photoreceptor and the developing roller.

As shown in FIG. 4, the state that the developing roller 421 opposes the photoreceptor 1 is shown. The developing roller 421 is rotatably supported by gap rollers 426 at its both ends. The gap rollers 426 are spacers which have radii larger than that of the developing roller 421, and are brought into contact with the outer circumferential surface of the photoreceptor 1 to accurately maintain the interval between the photoreceptor 1 and the developing roller 421. As shown in FIG. 3, the toner supply roller 422 and toner controlling member 423 are brought into contact with the developing roller 421. Accordingly, the developing roller 421 is pressed in the direction of the photoreceptor 1 by the contacting pressure of the toner supply roller 422 and toner controlling member 423.

It is so constructed that when the developing roller 421 is set in the developing device 4K, the gap between the developing roller 421 and the photoreceptor 1 becomes uniform in the direction of the rotation shaft of the developing roller 421. In this manner, even when the toner supply roller 422 and toner controlling member 423 come into contact with the developing roller 421, the gap between the developing roller 421 and the photoreceptor 1 can have a predetermined value which is uniform over the entire region along the rotation shaft of the developing roller 421, thereby achieving homogenization of the developed density.

[Developing Roller]

Figure 5A:
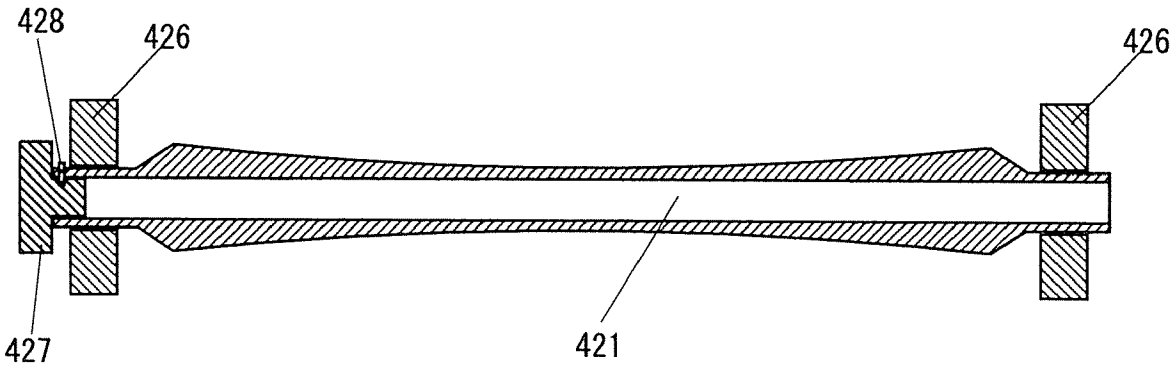
FIGS. 5A and 5B are cross-sectional views of the developing roller.
Figure 5B:
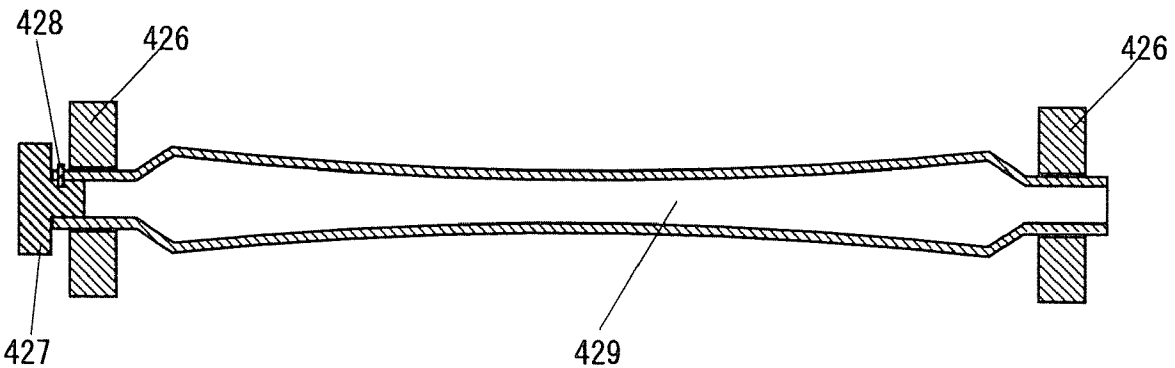

Examples of such a developing roller used include elastic rubber rollers and hollow aluminium rollers. FIG. 5 is a cross-sectional view of such a hollow aluminium roller. FIG. 5A is a cross-sectional view of the developing roller 421 which is produced by cutting an aluminium hollow tube (thickness: about 3 mm) whose outer diameter is the maximum diameter of the shape of an inverted crown to produce mating portions for the shape of an inverted crown and the gap roller 426. Furthermore, FIG. 5B is a cross-sectional view of the developing roller 429 which is produced by drawing an aluminium hollow tube having a thickness of about 1 mm to provide mating portions for the shape of an inverted crown and the gap roller 426. As shown in these figures, the developing roller 421 can be also provided with a gear 427 by using a pin 428.

[Positional Relationship Between Developing Roller and Peripheral Members]

The positional relationships of various peripheral members along the rotation shaft of the developing roller in the developing device according to this embodiment using such a hollow aluminium roller and an elastic rubber roller as the developing rollers will be described below with reference to FIGS. 6 to 12.

Figure 6:
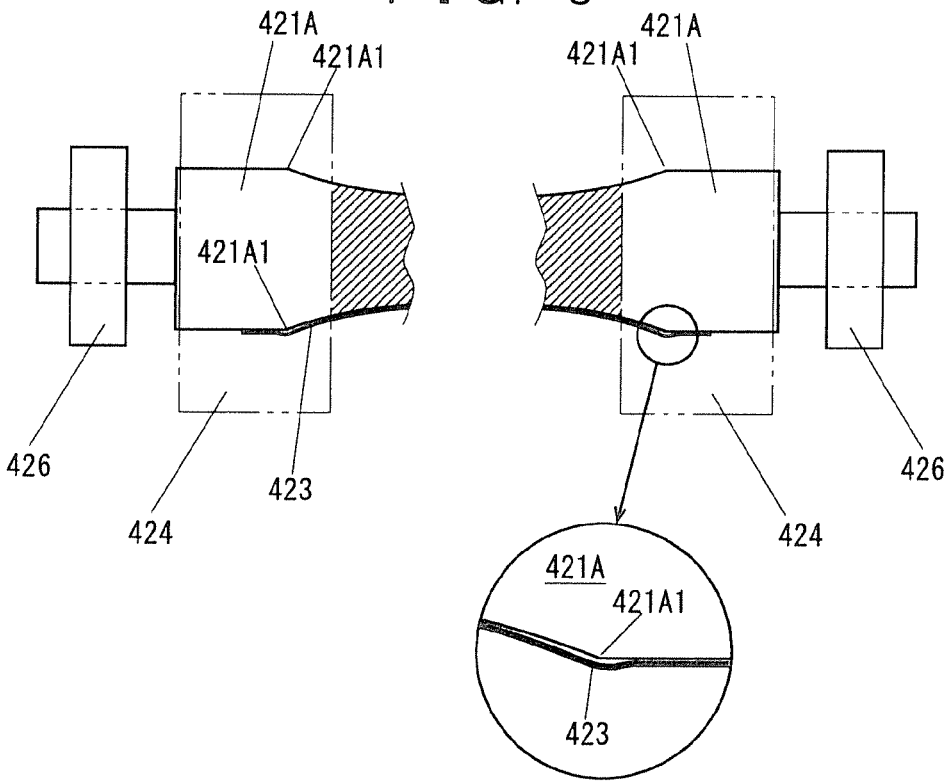
FIGS. 6 to 12 are drawings which show the positional relationship between the developing roller and peripheral members in the developing device according to an embodiment of the present invention.

A developing roller 421A shown in FIG. 6 is an elastic rubber roller (a roller in which an elastic rubber layer is provided around the periphery of the core). As shown in FIG. 6, from the central portion of this developing roller 421A towards the ends thereof, a central side end portion of the toner sealing member 424, a process starting point 421A1 of the shape of an inverted crown, and an outer side end of the toner controlling member 423 are disposed in the order stated. Herein, the central side and the outer side mean the central side and the outer side which is opposite to the central side of the developing device in the direction along the rotation shaft, respectively (and soon). Moreover, a toner thin layer region in the developing roller 421A is the central side of the toner sealing member 424 provided at both ends of the developing roller 421A, which is a shaded portion in the figure. In FIGS. 7 to 14, since this toner thin layer region is shaded in similar manners, this explanation will not be repeated. Furthermore, some of FIGS. 6 to 12 have expanded drawings attached thereto, but the toner sealing member 424 is not illustrated in these expanded drawings.

As shown in the expanded drawing of FIG. 6, a change in curvature is large at the process starting point 421A1 of the shape of an inverted crown, and the contacting state between the toner controlling member 423 and the developing roller 421A is unstable, which forms a gap therebetween. However, the process starting point 421A1 of this shape of an inverted crown exists outside the toner thin layer region in the developing roller 421A. That is, the starting point 421A1 of the shape of an inverted crown exists further outside than the toner thin layer region in the direction of the rotation shaft. In the toner thin layer region, the contacting state between the toner controlling member 423 and the developing roller 421A is stable and formation of a gap can be prevented (the contacting and nipping state is stable), and therefore spillage of the toner from the toner controlling member 423 is inhibited.

Figure 7:
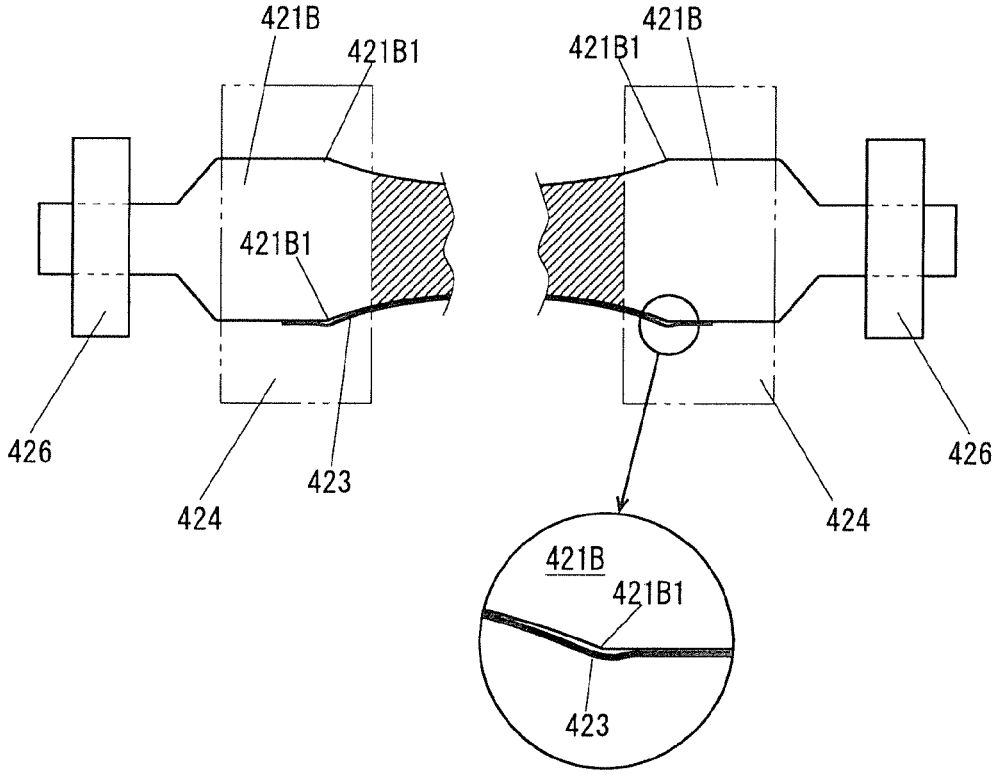

The developing roller 421B shown in FIG. 7 is a hollow aluminium roller (with no core comprising aluminium as a main component). As shown in FIG. 7, from the central portion of this developing roller 421B towards the ends thereof, a central end portion of the toner sealing member 424, the process starting point 421B1 of the shape of an inverted crown, and an outside end of the toner controlling member 423 are disposed in the order stated.

As shown in the expanded drawing of FIG. 7, a change in curvature is large in the process starting point 421B1 of the shape of an inverted crown, and the contacting state between the toner controlling member 423 and the developing roller 421B is unstable and a gap is formed therebetween. However, the process starting point 421B1 of this shape of an inverted crown exists outside the toner thin layer region in the developing roller 421B. That is, the starting point 421B1 of the shape of an inverted crown exists further outside than the toner thin layer region in the direction of the rotation shaft. In the toner thin layer region, the contacting state between the toner controlling member 423 and the developing roller 421B is stable and formation of a gap can be prevented (the contacting and nipping state is stable), spillage of the toner from the toner controlling member 423 is inhibited.

Figure 8:
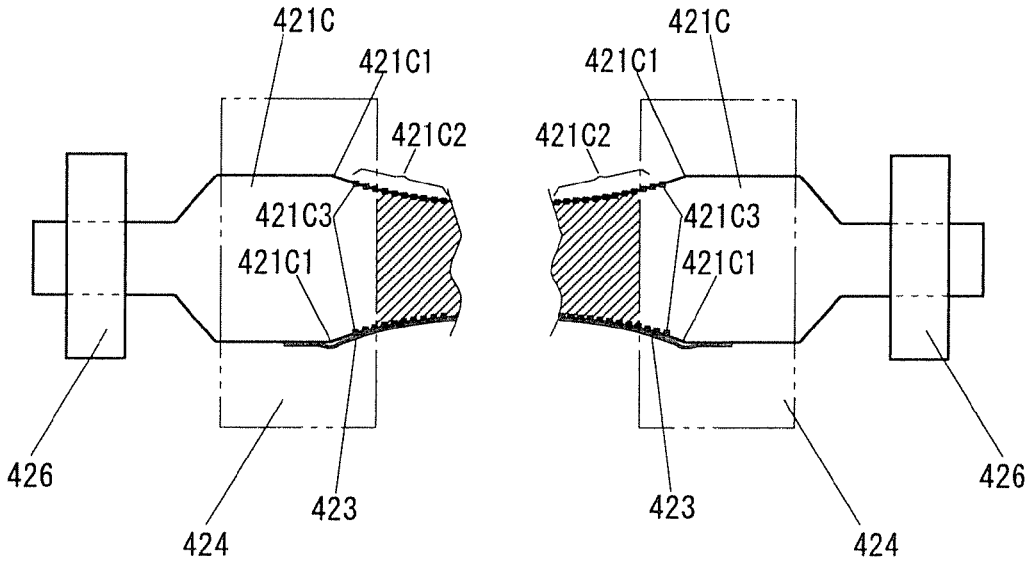

The developing roller 421C shown in FIG. 8 is a hollow aluminium blast roller (a roller with no core comprising aluminium as a main component, whose ability to carry toner has been improved by forming unevenness (fine roughening process) on the peripheral surface by the shot blast method). As shown in FIG. 8, from the central portion of this developing roller 421C towards the ends thereof, a central end portion of the toner sealing member 424, a starting point 421C3 of a finely roughened portion 421C2, a process starting point 421C1 of the shape of an inverted crown, and an outside end of the toner controlling member 423 are disposed in the order stated. It should be noted that the state of the finely roughened portion 421C2 does not indicate the appearance thereof, but merely schematically illustrates the fine roughening process. In this FIG. 8 and the following figures, this schematically illustrated fine roughening process is the same, and therefore this explanation will not be repeated.

As shown in FIG. 8, a change in curvature is large in the process starting point 421C1 of the shape of an inverted crown, the contacting state between the toner controlling member 423 and the developing roller 421C is unstable and a gap is formed therebetween. However, the process starting point 421C1 of this shape of an inverted crown exists outside the toner thin layer region in the developing roller 421C. That is, the starting point 421C1 of the shape of an inverted crown exists further outside than the toner thin layer region in the direction of the rotation shaft. In the toner thin layer region, the contacting state between the toner controlling member 423 and the developing roller 421C is stable and formation of a gap can be prevented (the contacting and nipping state is stable), and therefore spillage of the toner from the toner controlling member 423 is inhibited.

Figure 9:
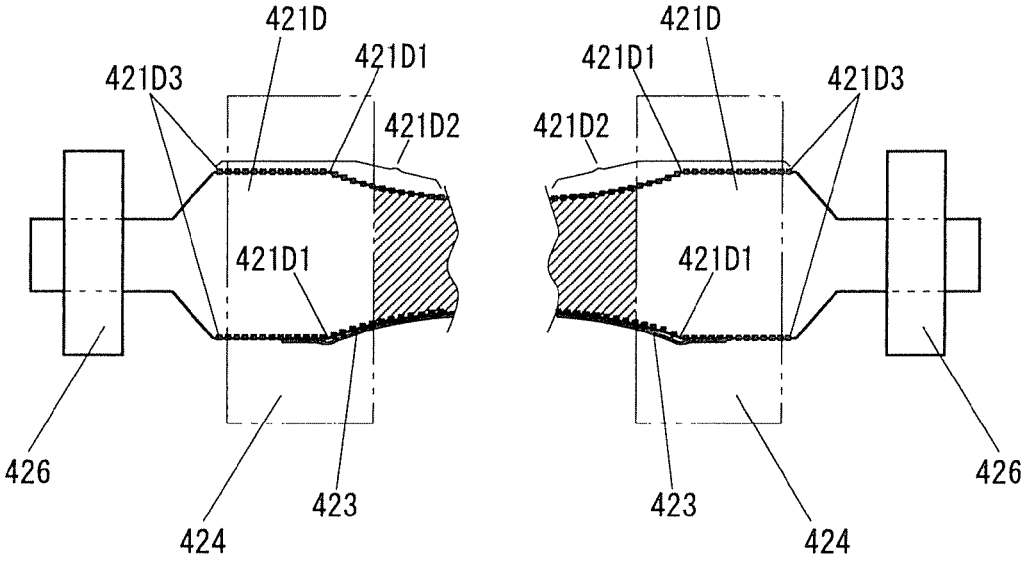

The developing roller 421D shown in FIG. 9 is also a hollow aluminium blast roller. As shown in FIG. 9, this developing roller 421D is comparable to the above-mentioned developing roller 421C, except that its finely roughened portion 421D2 is extended to the end of the developing roller 421D. As shown in FIG. 9, from the central portion of this developing roller 421D towards the ends thereof, the central end portion of the toner sealing member 424, a process starting point 421D1 of the shape of an inverted crown, the outside end of the toner controlling member 423, and the starting point 421D3 of the finely roughened portion 421D2 are disposed in the order stated. The positional relationship between the outside end of the toner sealing member 424 and the starting point 421D3 of the finely roughened portion 421D2 is not particularly limited.

As shown in FIG. 9, the process starting point 421D1 of the shape of an inverted crown exists outside the toner thin layer region in the developing roller 421D, like the above-mentioned developing roller 421C. That is, the starting point 421D1 of the shape of an inverted crown exists further outside than the toner thin layer region in the direction of the rotation shaft. In the toner thin layer region, the contacting state between the toner controlling member 423 and the developing roller 421D is stable and formation of a gap can be prevented (the contacting and nipping state is stable), and therefore spillage of the toner from the toner controlling member 423 is inhibited.

Figure 10:
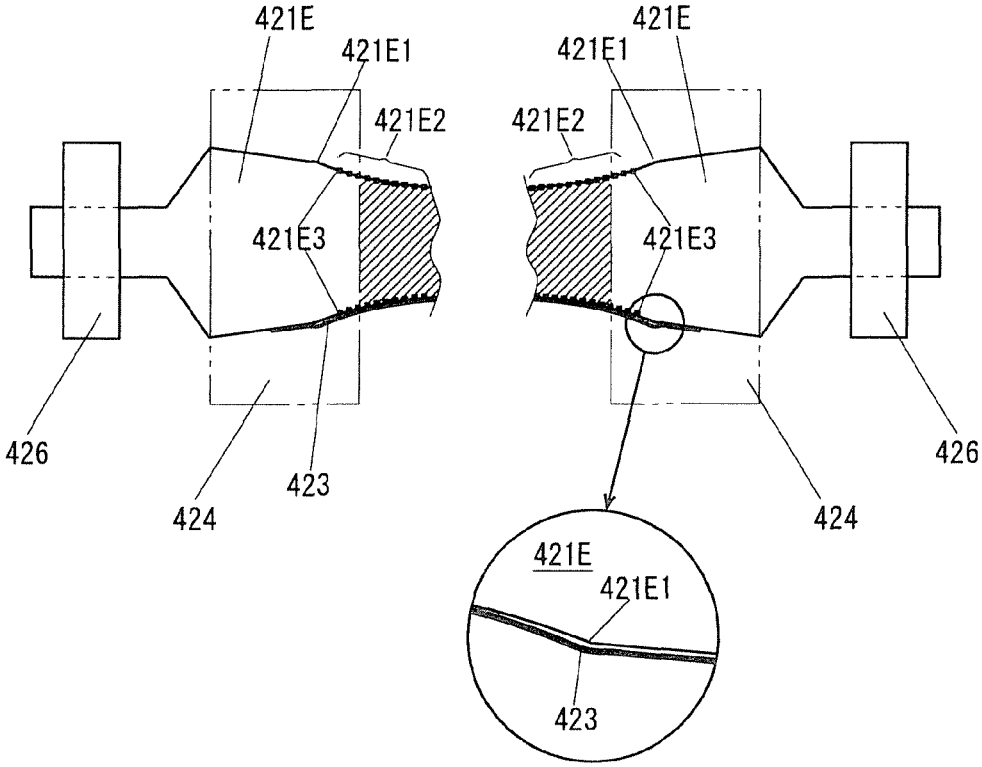

The developing roller 421E shown in FIG. 10 is also a hollow aluminium blast roller. As shown in FIG. 10, this developing roller 421E is comparable to the above-mentioned developing roller 421C, except that a tapering configuration is provided in which its outer diameter increases from a process starting point 421E1 of the shape of an inverted crown towards the outside of the developing roller 421E in the direction of the rotation shaft. As shown in FIG. 10, from the central portion of this developing roller 421E towards the ends thereof, a central end portion of the toner sealing member 424, a starting point 421E3 of a finely roughened portion 421E2, a process starting point 421E1 of the shape of an inverted crown, and the outside end of the toner controlling member 423 are disposed in the order stated.

As shown in FIG. 10, the process starting point 421E1 of the shape of an inverted crown exists outside the toner thin layer region in the developing roller 421E, like the above-mentioned developing roller 421C. That is, the starting point 421E1 of the shape of an inverted crown exists further outside than the toner thin layer region in the direction of the rotation shaft. In the toner thin layer region, the contacting state between the toner controlling member 423 and the developing roller 421E is stable and formation of a gap can be prevented (the contacting and nipping state is stable), spillage of the toner from the toner controlling member 423 is inhibited.

Figure 11:
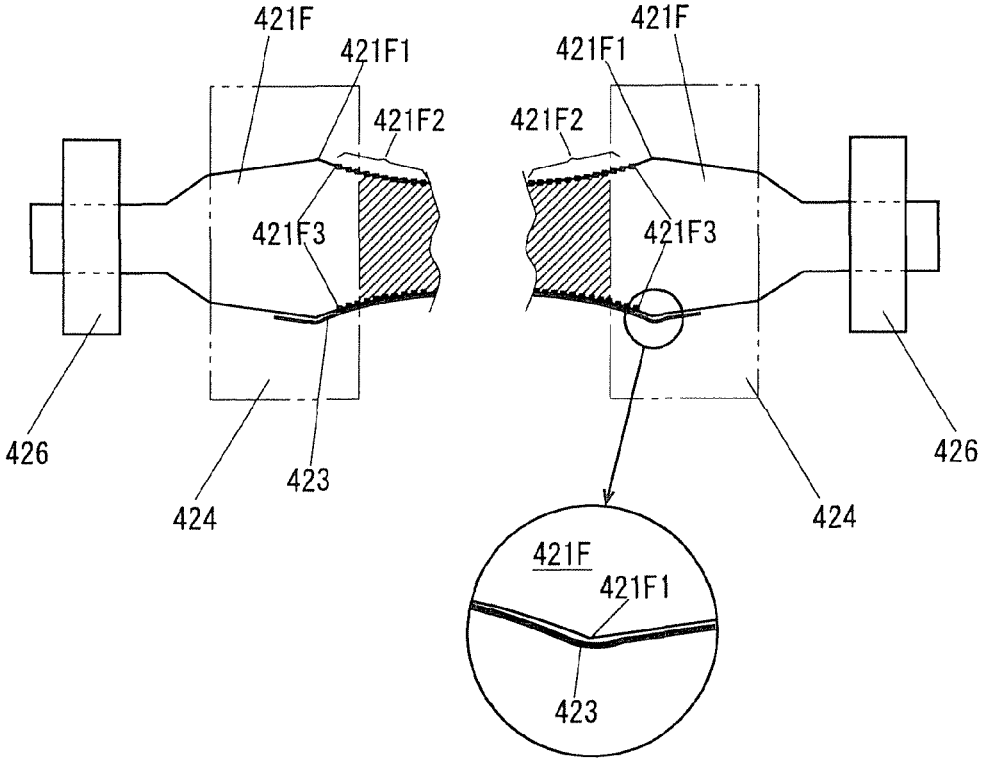

The developing roller 421F shown in FIG. 11 is also a hollow aluminium blast roller. As shown in FIG. 11, this developing roller 421F is comparable to the above-mentioned developing roller 421C and developing roller 421E, except that a tapering configuration is provided, in which its outer diameter decreases from a process starting point 421F1 of the shape of an inverted crown of the developing roller 421F towards the outside in the direction of the rotation shaft of the developing roller 421F. When a tapering configuration is provided in this manner, curvature is greatly changed at the process starting point 421F1 of the shape of an inverted crown. As shown in FIG. 11, from the central portion of this developing roller 421F towards the ends thereof, a central end portion of the toner sealing member 424, a starting point 421F3 of a finely roughened portion 421F2, a process starting point 421F1 of the shape of an inverted crown, and the outside end of the toner controlling member 423 are disposed in the order stated.

As shown in FIG. 11, the process starting point 421F1 of the shape of an inverted crown exists outside the toner thin layer region in the developing roller 421F, like the above-mentioned developing roller 421C and developing roller 421E. That is, the starting point 421F1 (point where curvature greatly changes) of the shape of an inverted crown exists further outside than the toner thin layer region in the direction of the rotation shaft. In the toner thin layer region, the contacting state between the toner controlling member 423 and the developing roller 421F is stable and formation of a gap can be prevented (the contacting and nipping state is stable), spillage of the toner from the toner controlling member 423 is inhibited.

Figure 12:
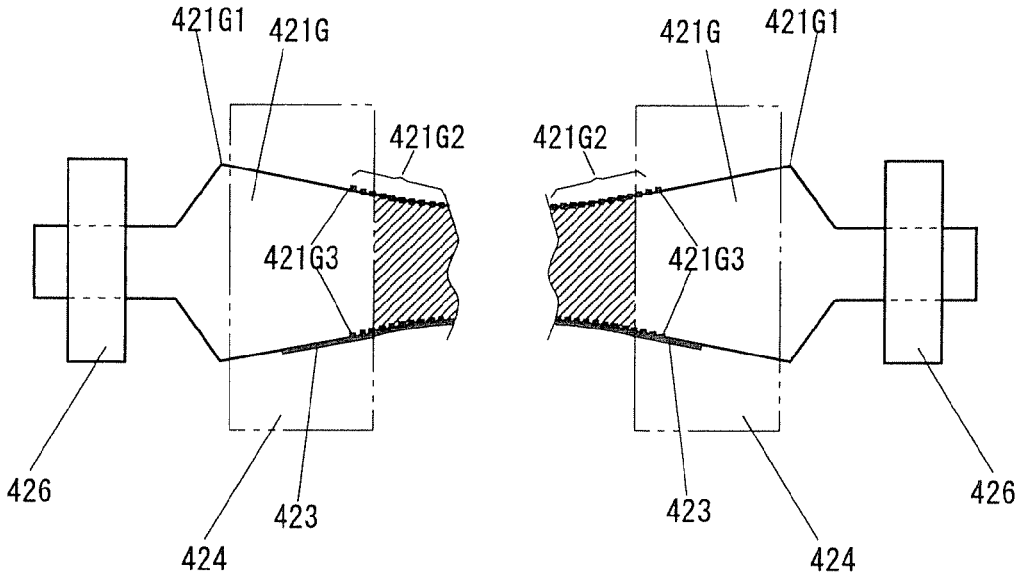

The developing roller 421G shown in FIG. 12 is also a hollow aluminium blast roller. As shown in FIG. 12, from the central portion of this developing roller 421G towards the ends thereof, a central end portion of the toner sealing member 424, a starting point 421G3 of a finely roughened portion 421G3, the outside end of the toner controlling member 423, and a process starting point 421G1 of the shape of an inverted crown are disposed in the order stated. The positional relationship between the outside end of the toner sealing member 424 and the process starting point 421G1 of the shape of an inverted crown is not particularly limited.

As shown in FIG. 12, a change in curvature is large in the process starting point 421G1 of the shape of an inverted crown, but since the toner controlling member 423 is not in contact with the shape of an inverted crown in this position, a gap does not exist between the toner controlling member 423 and the developing roller 421G. Therefore, spillage of the toner from the toner controlling member 423 is inhibited.

A developing device which is not a developing device according to this embodiment shown in FIGS. 6 to 12 described above will be now described.

Figure 13:
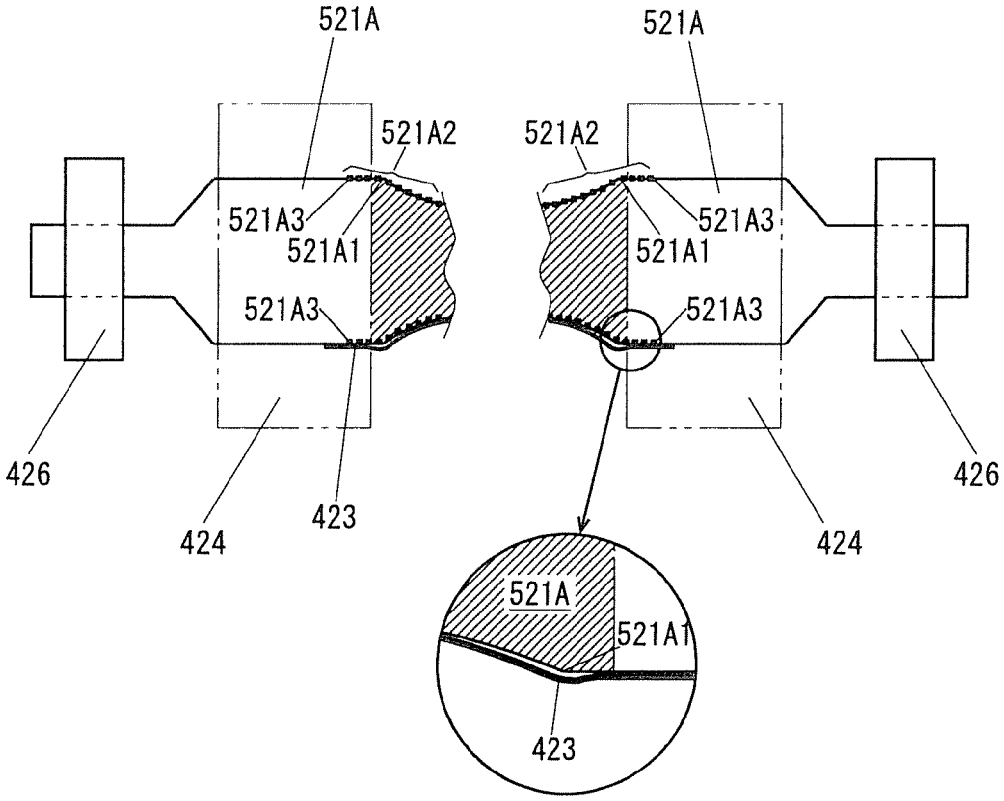
FIGS. 13 and 14 are drawings which show the positional relationship between the developing roller and peripheral members in another developing device.

The developing roller 521A shown in FIG. 13 is an elastic rubber roller or a hollow aluminium blast roller. As shown in FIG. 13, from the central portion of this developing roller 521A towards the ends thereof, a process starting point 521A1 of the shape of an inverted crown, a central end portion of the toner sealing member 424, a starting point 521A3 of a finely roughened portion 521A3, and an outside end of the toner controlling member 423 are disposed in the order stated.

As shown in FIG. 13, a change in curvature is large in the process starting point 521A1 of the shape of an inverted crown, and the contacting state between the toner controlling member 423 and the developing roller 521A is unstable and a gap is formed therebetween. In addition, the process starting point 521A1 of this shape of an inverted crown exists within the toner thin layer region in the developing roller 521A. That is, the starting point 521A1 of the shape of an inverted crown exists closer to the central side than the toner thin layer region in the direction of the rotation shaft. In the toner thin layer region, the contacting state between the toner controlling member 423 and the developing roller 521A is unstable and a gap is formed (the contacting and nipping state is not stable), and therefore spillage of the toner from the toner controlling member 423 occurs.

Figure 14:
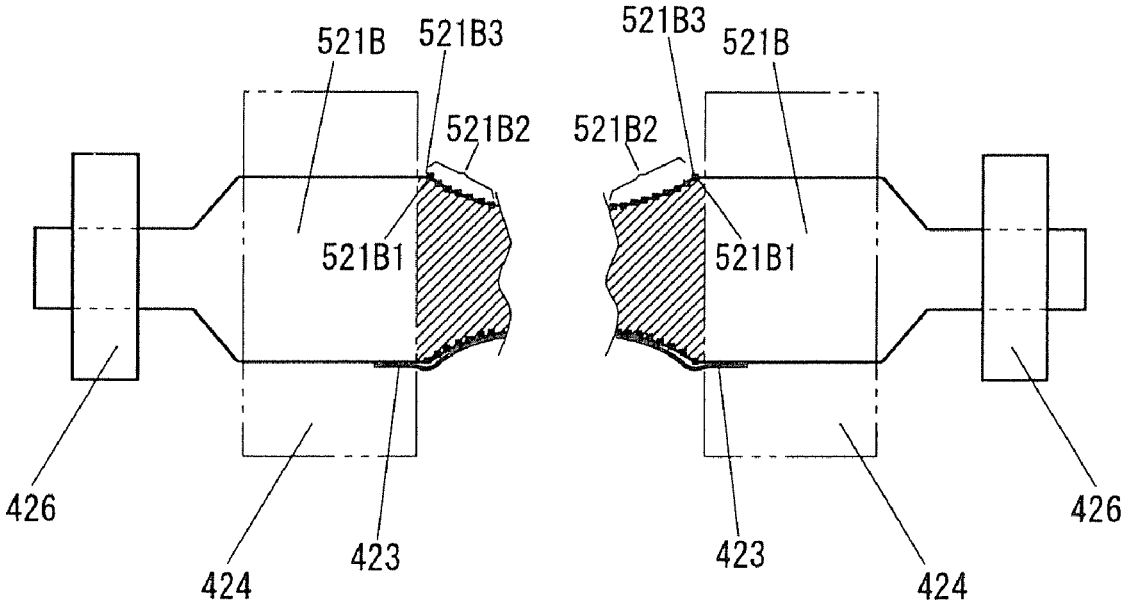

The developing roller 521B shown in FIG. 14 is an elastic rubber roller or a hollow aluminium blast roller as the developing roller 521A. As shown in FIG. 14, from the central portion of this developing roller 521B towards the ends thereof, the process starting point 521B1 of the shape of an inverted crown, the starting point 521B3 of the finely roughened portion 521B2 (the position which is almost the same as the process starting point 521B1 of the shape of an inverted crown), the central end portion of the toner sealing member 424, and an outside end of the toner controlling member 423 are disposed in the order stated. That is, in the constitution of the above-mentioned developing roller 521A, the starting point 521B3 of the finely roughened portion 521B2 exists within the toner thin layer region.

As shown in FIG. 14, a change in curvature is large in the process starting point 521B1 of the shape of an inverted crown, and the contacting state between the toner controlling member 423 and the developing roller 521B is unstable and a gap is formed therebetween. In addition, the process starting point 521B1 of this shape of an inverted crown exists within the toner thin layer region in the developing roller 521B. That is, the starting point 521B1 of the shape of an inverted crown exists closer to the central side than the toner thin layer region in the direction of the rotation shaft. In the toner thin layer region, the contacting state between the toner controlling member 423 and the developing roller 521B is unstable and a gap is formed (the contacting and nipping state is not stable), spillage of the toner from the toner controlling member 423 occurs. Furthermore, since the finely roughened portion 521B2 is not pressed by the toner sealing member 424 (a portion of the developing roller 521B which has not been finely roughened exists within the toner thin layer region), the toner deposited to the portion of the developing roller 521B which has not been finely roughened is scattered.

As mentioned above, according to the developing device and image forming device of this embodiment, in a case where the device is a mono-component developing device and comprises a toner controlling member and a developing roller and which is brought into contact with the developing roller, and the developing roller is formed in the shape of an inverted crown which is concave at the central portion in the direction of the rotation shaft, the starting point position of the shape of an inverted crown is provided further outside than the toner thin layer region formed by the toner controlling member in the direction of the rotation shaft. Accordingly, a change in curvature is large at the process starting point of the shape of an inverted crown, and the contacting state between the toner controlling member and the developing roller is unstable and a gap is formed therebetween. However, this process starting point of the shape of an inverted crown exists outside the toner thin layer region in the developing roller, and in the toner thin layer region, the contacting state between the toner controlling member and the developing roller is stable and formation of a gap can be prevented (the contacting and nipping state is stable). Therefore, spillage of the toner from the toner controlling member can be inhibited.

The developing rollers shown in FIGS. 7 to 12 may be formed of elastic rubber rollers. Moreover, the surface of the developing roller may be or may not be finely roughened.

Herein, the developing device according to the present invention can be as described below, and the image forming device according to the present invention can comprise a developing device in a mode described below.

The toner thin layer forming member, which is a sheet-like component provided along the rotation shaft of the developer carrier roller, brings a toner sealing member which is wide in the direction of the rotation shaft into contact with both ends of the roller so that the thin layer region can be formed in a portion which is closer to the central portion than the toner sealing members at both ends of the roller by the toner thin layer forming member. Along the rotation shaft of the developer carrier roller, from the central portion of the roller towards each end thereof, the end portion of the toner sealing member on the central side of the roller and the starting point position of the shape of an inverted crown can be also disposed in the order stated.

According to this developing device, from the central portion of the developer carrier roller towards each end thereof, the end of the toner sealing member on the central side and the starting point position of the shape of an inverted crown are disposed in the order stated. Moreover, the toner thin layer region is formed in a portion closer to the central portion than the toner sealing member at both ends of the roller by the toner thin layer forming member. This makes the starting point of the shape of an inverted crown to be positioned further outside (on the end side) in the direction of the rotation shaft than the toner thin layer region. In the toner thin layer region, the contacting state of the toner thin layer forming member and the developer carrier roller is stable, and therefore spillage of the toner from the toner thin layer forming member can be inhibited Furthermore, along the rotation shaft of the developer carrier roller, from the central portion of the roller towards each end thereof, the end portion of the toner sealing member on the central side of the roller, the starting point position of the shape of an inverted crown, and the outer end portion of the toner thin layer forming member can be also disposed in the order stated.

According to this developing device, from the central portion of the developer carrier roller towards each end thereof, the end portion of the toner sealing member on the central side, the starting point position of the shape of an inverted crown, and the outer end portion of the toner thin layer forming member are disposed in the order stated. Moreover, the toner thin layer region is formed in a portion closer to the central portion than the toner sealing member at both ends of the roller by the toner thin layer forming member. This makes the starting point of the shape of an inverted crown to be positioned further outside (end side) in the direction of the rotation shaft than the toner thin layer region. In the toner thin layer region, the contacting state of the toner thin layer forming member and the developer carrier roller is stable, and therefore spillage of the toner from the toner thin layer forming member can be inhibited The surface of the developer carrier roller can be finely roughened from one end to the other end of the roller. Along the rotation shaft of the developer carrier roller, from the central portion of the roller towards each end thereof, the end of the toner sealing member on the central side, the starting point position of the fine roughening process, the starting point position of the shape of an inverted crown, and the outer end portion of the toner thin layer forming member can be also disposed in the order stated.

According to this developing device, from the central portion of the finely roughened developer carrier roller towards the ends thereof, the end of the toner sealing member on the central side, the starting point position of the fine roughening process, the starting point position of the shape of an inverted crown, and the outer end portion of the toner thin layer forming member are disposed in the order stated. Disposing the components in this order and forming the toner thin layer region in a portion closer to the central portion than the toner sealing members at both ends by the toner thin layer forming member cause the starting point position of the shape of an inverted crown to exist further outside than the toner thin layer region in the direction of the rotation shaft. In the toner thin layer region, the contacting state of the toner thin layer forming member and the developer carrier roller is stable, and therefore spillage of the toner from the toner thin layer forming member can be inhibited.

Furthermore, along the rotation shaft of the developer carrier roller, from the central portion of the roller towards each end thereof, the end of the toner sealing member on the central side, the starting point position of the shape of an inverted crown, the outer end of the toner thin layer forming member, and the starting point position of the fine roughening process can be also disposed in the order stated.

According to this developing device, from the central portion of the finely roughened developer carrier roller towards the ends thereof, the end of the toner sealing member on the central side, the starting point position of the shape of an inverted crown, the outer end of the toner thin layer forming member, and the starting point position of the fine roughening process are disposed in the order stated. Disposing the components in this order and forming the toner thin layer region in a portion closer to the central portion than the toner sealing members at both ends by the toner thin layer forming member cause the starting point position of the shape of an inverted crown to exist further outside than the toner thin layer region in the direction of the rotation shaft. In the toner thin layer region, the contacting state of the toner thin layer forming member and the developer carrier roller is stable, and therefore spillage of the toner from the toner thin layer forming member can be inhibited Furthermore, along the rotation shaft of the developer carrier roller, from the central portion of the roller towards each end thereof, the end of the toner sealing member on the central side, the starting point position of the fine roughening process, the outer end of the toner thin layer forming member, and the starting point position of the shape of an inverted crown can be also disposed in the order stated.

According to this developing device, from the central portion of the finely roughened developer carrier roller towards the ends thereof, the end of the toner sealing member on the central side, the starting point position of the fine roughening process, the outer end of the toner thin layer forming member, and the starting point position of the shape of an inverted crown are disposed in the order stated. Disposing the components in this order and forming the toner thin layer region in a portion closer to the central portion than the toner sealing members at both ends by the toner thin layer forming member cause the starting point position of the shape of an inverted crown to exist further outside than the toner thin layer region in the direction of the rotation shaft. In the toner thin layer region, the contacting state of the toner thin layer forming member and the developer carrier roller is stable, and therefore spillage of the toner from the toner thin layer forming member can be inhibited.

The developing device can further comprise a toner feed member and a diselectrifying member provided to face the developer carrier roller. Such a constitution allows the toner to be supplied to the developer carrier roller, and allows the toner which is returned in a state that it is left supported on the developer carrier roller to be diselectrified.

When the developing device is set in the image forming device, the gap between the developer carrier roller and the electrostatic latent image carrier becomes constitutionally uniform in the direction of the rotation shaft. Such a constitution allows the gap between the developer carrier roller and the electrostatic latent image carrier to have a predetermined value which is uniform over the entire region along the rotation shaft.

As described above, the present invention can provide an image forming device which is capable of forming an electrostatic latent image on an electrostatic latent image carrier and develop the electrostatic latent image to form a toner image, the image forming device being a mono-component developing device used for development of the electrostatic latent image, comprising a developer carrier roller which is rotationally driven and a toner thin layer forming member which is brought into contact with the roller, the roller being formed in the shape of an inverted crown which is concave at the central portion in the direction of the rotation shaft, the developing device being capable of maintaining the clearance between the developer carrier roller and the drum photoreceptor to a constant value and carry out good image formation, and inhibiting spillage, scattering and leakage of the toner even if the developer carrier roller has the shape of an inverted crown to prevent the inside of image forming device from being contaminated.

The present invention can also provide an image forming device which is capable of forming an electrostatic latent image on an electrostatic latent image carrier and develop the electrostatic latent image by a developing device to form a toner image, maintaining the clearance between the developer carrier roller and the drum photoreceptor to a constant value and carrying out good image formation, and inhibiting contamination of the inside of the image forming device by spillage, scattering and leakage of the toner even if the developer carrier roller has the shape of an inverted crown.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device used for forming a toner image by developing the electrostatic latent image on an electrostatic latent image carrier in an image forming device, comprising:

a developer carrier roller which is rotationally driven, and a toner thin layer forming member which is brought into contact with the developer carrier roller, wherein the developer carrier roller is formed in the shape of an inverted crown which is concave at the central portion in the direction of the rotation axis, and a starting point of the shape of the inverted crown is positioned further outside in the direction of the rotation axis than toner thin layer region formed by the toner thin layer forming member.

2. A developing device according to claim 1, further comprising toner sealing members which are in contact with both ends of the developer carrier roller, wherein the toner thin layer forming member is a sheet-like component provided along the rotation axis of the developer carrier roller, the toner thin layer region is formed in a portion closer to the central portion than the toner sealing members at both ends of the developer carrier roller by the toner thin layer forming member, and an end of the toner sealing member on the central side of the developer carrier roller, and the starting point position of the shape of an inverted crown are disposed in the order stated along the rotation axis of the developer carrier roller from the central portion of the developer carrier roller towards each end thereof.

3. A developing device according to claim 1, further comprising toner sealing members which are in contact with both ends of the developer carrier roller, wherein the toner thin layer forming member is a sheet-like component provided along the rotation axis of the developer carrier roller, the toner thin layer region is formed in a portion closer to the central portion than the toner sealing members at both ends of the developer carrier roller by the toner thin layer forming member, and an end of the toner sealing member on the central side of the developer carrier roller, the starting point position of the shape of an inverted crown, and an outer end of the toner thin layer forming member are disposed in the order stated along the rotation axis of the developer carrier roller from the central portion of the developer carrier roller towards each end thereof.

4. A developing device according to claim 3, wherein the developer carrier roller has a finely roughened area on the surface, and the end of the toner sealing member on the central side, an outer end of the finely roughened area, the starting point position of the shape of an inverted crown, and an outer end of the toner thin layer forming member are disposed in the stated along the rotation axis of the developer carrier roller from the central portion of the developer carrier roller towards each end thereof.

5. A developing device according to claim 3, wherein the developer carrier roller has a finely roughened area on the surface, and the end of the toner sealing member on the central side, the starting point position of the shape of an inverted crown, the outer end of the toner thin layer forming member, and an outer end of the finely roughened area are disposed in the order stated along the rotation axis of the developer carrier roller from the central portion of the developer carrier roller towards each end thereof.

6. A developing device according to claim 3, wherein the developer carrier roller has a finely roughened area on the surface, and the end of the toner sealing member on the central side, an outer end of the finely roughened area, the outer end of the toner thin layer forming member, and the starting point position of the shape of an inverted crown are disposed in the order stated along the rotation axis of the developer carrier roller from the central portion of the developer carrier roller towards each end thereof.

7. A developing device according to claims 1, further comprising a toner feed member and a diselectrifying member provided to face the developer carrier roller.

8. A developing device according to claim 1, wherein when the developing device is set in the image forming device, a gap between the developer carrier roller and the electrostatic latent image carrier becomes uniform in the direction of the rotation axis.

9. An image forming device comprising:

an electrostatic latent image carrier; and a developing device forming a toner image by developing the electrostatic latent image on the electrostatic latent image carrier, wherein the developing device comprises a developer carrier roller which is rotationally driven, and a toner thin layer forming member which is brought into contact with the developer carrier roller, the developer carrier roller is formed in the shape of an inverted crown which is concave at the central portion in the direction of the rotation axis, and a starting point of the shape of the inverted crown is positioned further outside in the direction of the rotation axis than the toner thin layer region formed by the toner thin layer forming member.

10. An image forming device according to claim 9, wherein the developing device further comprises toner sealing members which are in contact with both ends of the developer carrier roller, the toner thin layer forming member is a sheet-like component provided along the rotation axis of the developer carrier roller, the toner thin layer region is formed in a portion closer to the central portion than the toner sealing members at both ends of the developer carrier roller by the toner thin layer forming member, and an end of the toner sealing member on the central side of the developer carrier roller, and the starting point position of the shape of an inverted crown are disposed in the order stated along the rotation axis of the developer carrier roller from the central portion of the developer carrier roller towards each end thereof.

11. An image forming device according to claim 9, wherein the developing device further comprises toner sealing members which are wide in the direction of the rotation axis are in contact with both ends of the developer carrier roller, the toner thin layer forming member is a sheet-like component provided along the rotation axis of the developer carrier roller, the toner thin layer region is formed in a portion closer to the central portion than the toner sealing members at both ends of the developer carrier roller by the toner thin layer forming member, and an end of the toner sealing member on the central side of the developer carrier roller, and the starting point position of the shape of an inverted crown, and an outer end of the toner thin layer forming member are disposed in the order stated along the rotation axis of the developer carrier roller from the central portion of the developer carrier roller towards each end thereof.

12. An image forming device according to claim 11, wherein the developer carrier roller has a finely roughened area on the surface, and the end of the toner sealing member on the central side, an outer end of the finely roughened area, the starting point position of the shape of an inverted crown, and an outer end of the toner thin layer forming member are disposed in the stated along the rotation axis of the developer carrier roller from the central portion of the developer carrier roller towards each end thereof.

13. An image forming device according to claim 11, wherein the surface of the developer carrier roller has a finely roughened area on the surface, and the end of the toner sealing member on the central side, the starting point position of the shape of an inverted crown, the outer end of the toner thin layer forming member, and an outer end of the finely roughened area are disposed in the order stated along the rotation axis of the developer carrier roller from the central portion of the developer carrier roller towards each end thereof.

14. An image forming device according to claim 11, wherein the developer carrier roller has a finely roughened area on the surface, and the end of the toner sealing member on the central side, an outer end of the finely roughened area, the outer end of the toner thin layer forming member, and the starting point position of the shape of an inverted crown are disposed in the order stated along the rotation axis of the developer carrier roller from the central portion of the developer carrier roller towards each end thereof.

15. An image forming device according to claim 9, wherein the developing device further comprises a toner feed member and a diselectrifying member provided to face the developer carrier roller.

16. An image forming device according to claim 9, wherein when the developing device is set in the image forming device, a gap between the developer carrier roller and the electrostatic latent image carrier becomes uniform in the direction of the rotation axis.

* * * * *